US007770727B2

(12) United States Patent
Meng

(10) Patent No.: US 7,770,727 B2
(45) Date of Patent: Aug. 10, 2010

(54) DRIVER BIT CONTAINER

(76) Inventor: Chi-Fen Meng, P.O. Box 215, Taichung (TW) 40099

( * ) Notice: Subject to any disclaimer, the term of this patent is extended or adjusted under 35 U.S.C. 154(b) by 237 days.

(21) Appl. No.: 11/898,663

(22) Filed: Sep. 14, 2007

(65) Prior Publication Data

US 2009/0001116 A1 Jan. 1, 2009

(30) Foreign Application Priority Data

Jun. 29, 2007 (TW) ..... 96210708 U

(51) Int. Cl.
*B65D 85/28* (2006.01)

(52) U.S. Cl. ..... 206/373; 206/379

(58) Field of Classification Search ..... 206/349, 206/377, 378, 370, 372, 373, 375; 220/4.21–4.24, 220/4.01, 4.03, 4.26, 4.28, 4.32–4.34, 503, 220/529; 224/666–668, 676, 678–679, 681, 224/904; D3/294, 905

See application file for complete search history.

(56) References Cited

U.S. PATENT DOCUMENTS 5,512,165 A * 4/1996 Liu ..... 206/234
5,782,150 A * 7/1998 Huang ..... 81/177.4
6,050,409 A * 4/2000 Delbeck et al. ..... 206/375
6,405,865 B1 * 6/2002 Lin ..... 206/379
6,615,983 B1 * 9/2003 Yu ..... 206/372
6,915,900 B2 * 7/2005 Chen ..... 206/350
6,966,165 B2 * 11/2005 Hernandez et al. ..... 53/416
6,978,890 B2 * 12/2005 Pangerc et al. ..... 206/349
D532,603 S * 11/2006 Chen ..... D3/228
7,168,559 B2 * 1/2007 Chen ..... 206/373
2002/0139822 A1 * 10/2002 Infanti ..... 224/197

* cited by examiner

*Primary Examiner*—Ehud Gartenberg
*Assistant Examiner*—Ernesto A Grano

(57) ABSTRACT

A driver bit container comprises: a main body, a clip and two containing caps. In the center of main body sets a longitudinal cavity for containing bit holders and there are two symmetrical containers on both sides of the longitudinal cavity with each of them divided longitudinally into two parts: a row of containing slots and an elongated concave. The clip is mounted on the backside of, and can rotate against the main body. Each of the containing caps has a row of side containing slots and a side elongated concave to cooperate with the said elongated concave and said containing slots respectively. Therefore, the invention has features of capability of containing more bits and easy to use.

6 Claims, 8 Drawing Sheets

DRIVER BIT CONTAINER

BACKGROUND OF THE INVENTION

The invention is to propose a driver bit container that is easy to carry and easy for users to contain bits.

In prior arts such as Taiwan Patent No. 576300, 590061, and 1245693, although they all have features of small size and easy carry, they have drawbacks in common, such as: the main container, which has bit containing slots, is designed as independent part, thus it needs to pivot with box main body to perform rotation function, and in such case, the box main body can only purely acts as a capping body, which could not make a good use of the space and makes containing space limited.

Besides, prior arts adopt components with mono function, thus it will cause hassles of excessive parts, high molding costs, and complicated assembly. To avoid the drawbacks of prior arts, the inventor underwent numerous researches and tests, and finally presents you this invention for patent application.

BRIEF SUMMARY OF THE INVENTION

The purpose of this invention is to propose a driver bit container that just needs few parts, has easy assembly, can lower manufacturing costs, can contain more bits than prior arts, easy demonstration, and easy to use. To this end, the proposed driver bit container comprises: a main body, a clip and two containing caps.

In the center of main body sets a longitudinal cavity and there are two symmetrical containers on both sides of the longitudinal cavity with each of them divided longitudinally into two parts: a row of containing slots and an elongated concave. The clip is mounted on the backside of the longitudinal cavity of the main body. The two containing caps are pivoted with bottom part of the two containers respectively so that they can cap on the containers by rotation. Moreover, each of the containing caps also has a row of side containing slots and a side elongated concave to cooperate with the said elongated concave and said containing slots respectively. With aforementioned, both main body and containing caps can contain driver bits, so the invention has features of few parts, easy assembly, and capability of containing more bits than prior arts and easy to use.

DETAILED DESCRIPTION OF THE INVENTION

With references to attached figures, please be described of preferred embodiment of this invention as follows. First, with references to FIG. 1-5, the proposed driver bits container comprises a main body 10, a clip 20 and two containing caps 30 mounted respectively on both sides of the main body 10.

Figure 7:
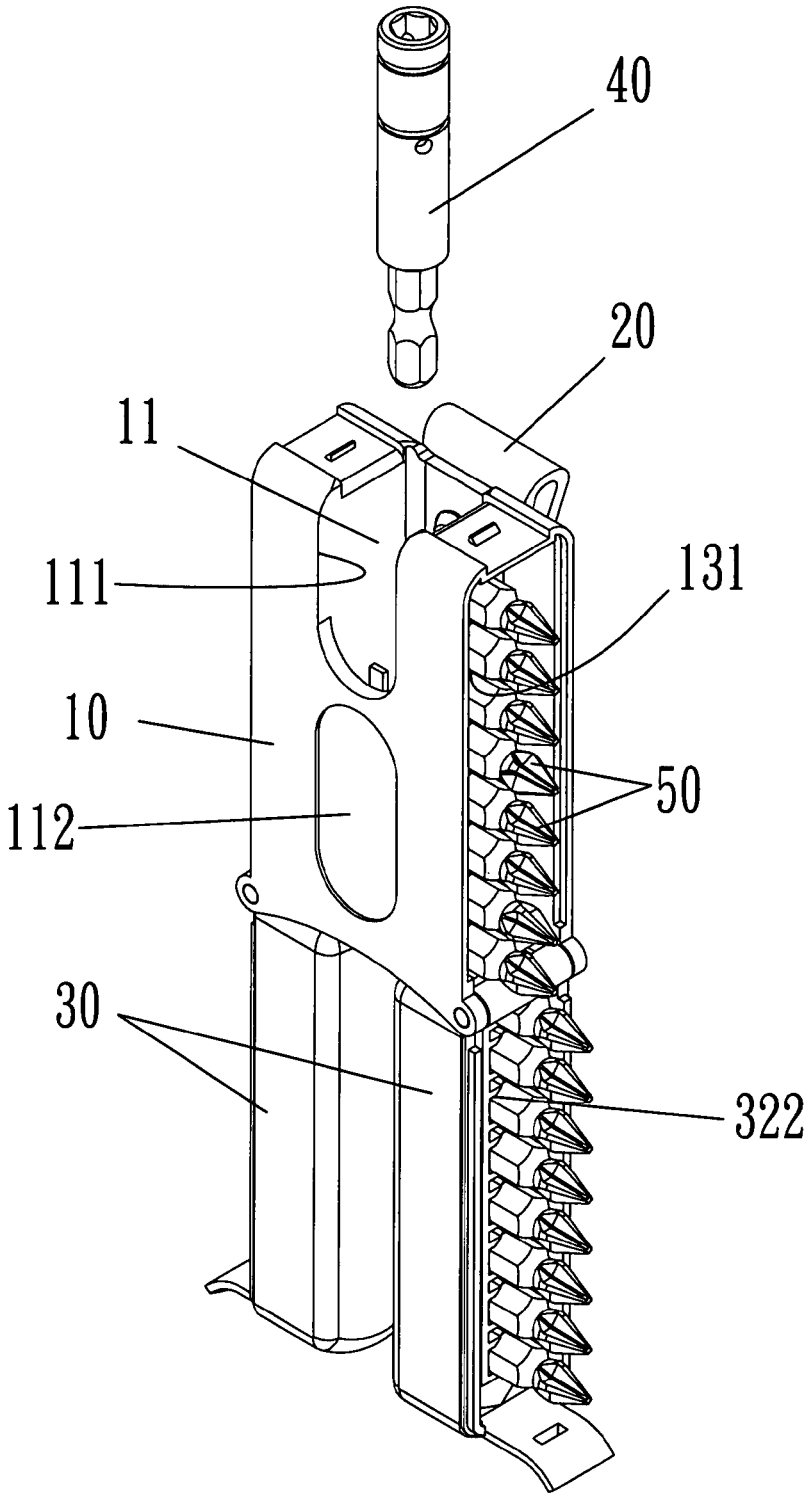
FIG. 7—an open-up view of the preferred embodiment when being used

In the center of main body 10 sets a longitudinal cavity 11 that is used to contain the bit holder 40 (as shown in FIG. 7), and has a hole 12 on backside of its inner wall for connecting with the projecting head 24 of the clip 20, making the clip 20 rotatable against the main body 10 so as to conveniently clip onto a belt or display shelf; The main body 10 further has two symmetrical containers 13 on both sides of the longitudinal cavity 11, and each of them is divided longitudinally into two parts: a row of containing slots 131 and a elongated concave 132; Moreover, the main body 10 has, at its bottom, symmetrical pivots 14, each of which sets a pivot hole 141 for connecting rods 142 to penetrate through to connect the main body 10 and the containing caps 30. And furthermore, on top of the containers 13 symmetrically set positioning lumps 15 used to buckle with the positioning concaves 331 of the containing caps 30 when the containing caps 30 completely cap onto the containers 13.

The clip 20 has a hanging hole 21 at its bottom, and a curved clipping body 22 at its top for purpose of clipping onto the user's belt. Moreover, on outer side of the curved clipping body 22 sets a projecting head 24 for connecting the clip 20 with the main body 10 at the hole 12.

Figure 5:
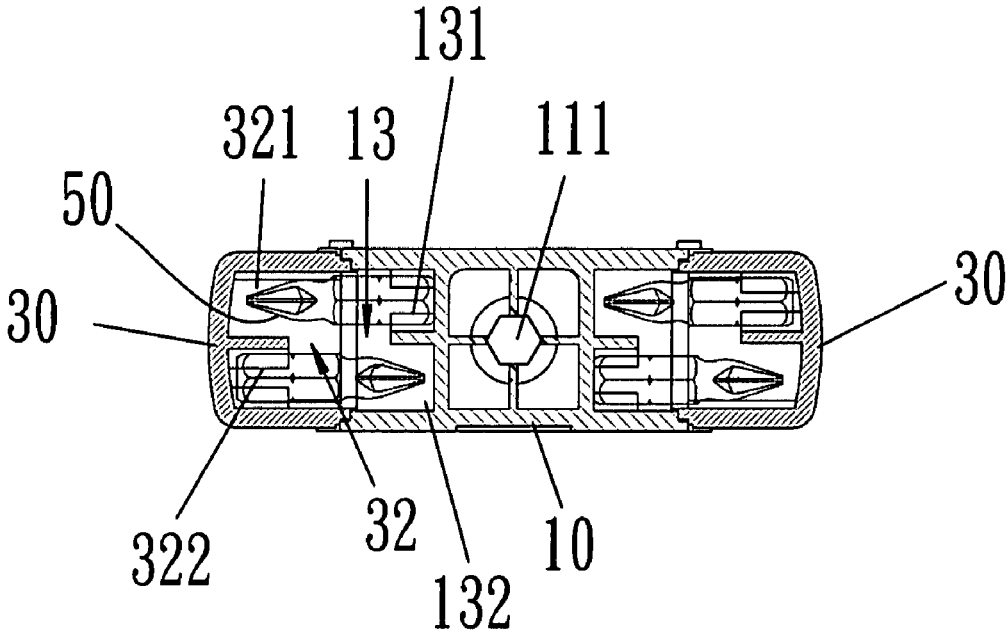
FIG. 5—a sectional view of the preferred embodiment
Figure 6:
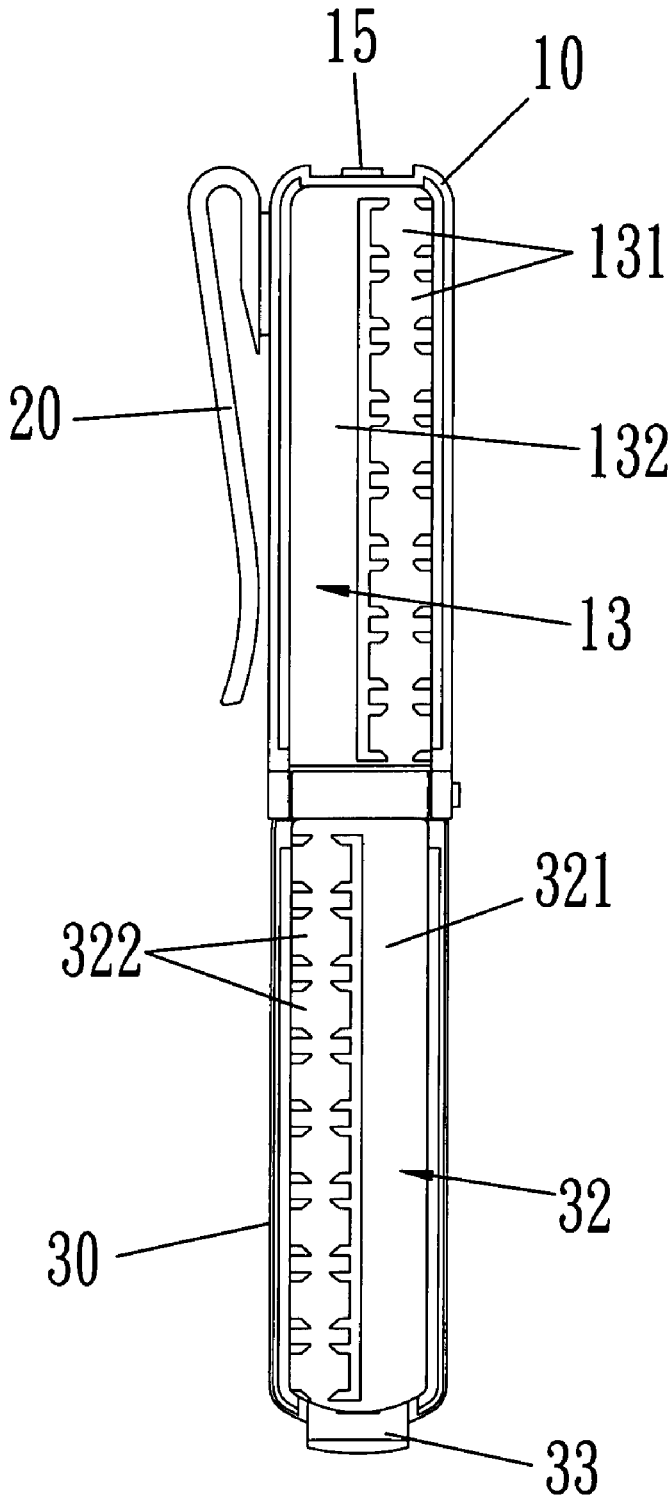
FIG. 6—an open-up view of a containing cap of the preferred embodiment

Each of the containing caps 30 has a tubing component 31 at its bottom, which is to stay between the two pivots 14 of the containing cap's corresponding container 13, so as for the connecting rods 142 to penetrate associated pivot holes 141 and the tubing components 31 to connect the main body 10 with containing caps 30. Each of the containing caps 30 further has a side container 32, which is also divided into two parts: a row of side containing slots 322 and a side elongated concave 321 (cooperate with the elongated concave 132 and containing slots 131 respectively as shown in FIGS. 5 and 6.) Thus, the limited space of main body 10 and the containing caps 30 can be efficiently utilized to contain more driver bits. Furthermore, there are outward curved plates 33 on top of the containing caps 30 for users to open the caps 30 easily, and at proper location of the outward curved plates 33 sets positioning concaves 331 to buckle with the positioning lumps 15 of main body 10 for positioning purpose.

Figure 8:
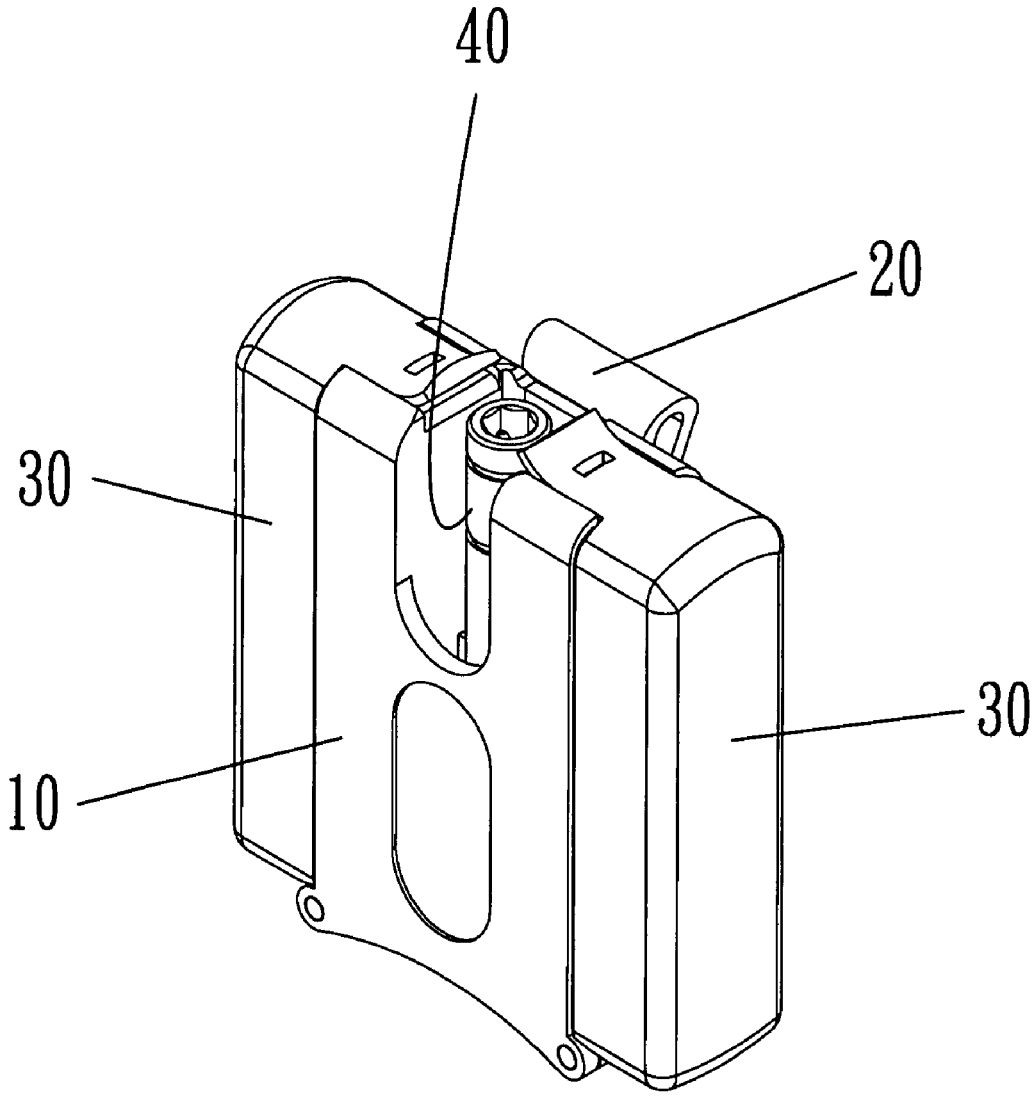
FIG. 8—a close-up view of FIG. 7

With aforementioned components and structures (references to FIGS. 7 and 8), the side containing slots 322 of containing caps 30 and containing slots 131 of main body 10 are used to contain driver bits. When driver bits are put in the containing slots, one end of the bit will project out of the slot for easy pull-out and spec. demonstration purpose.

Figure 1:
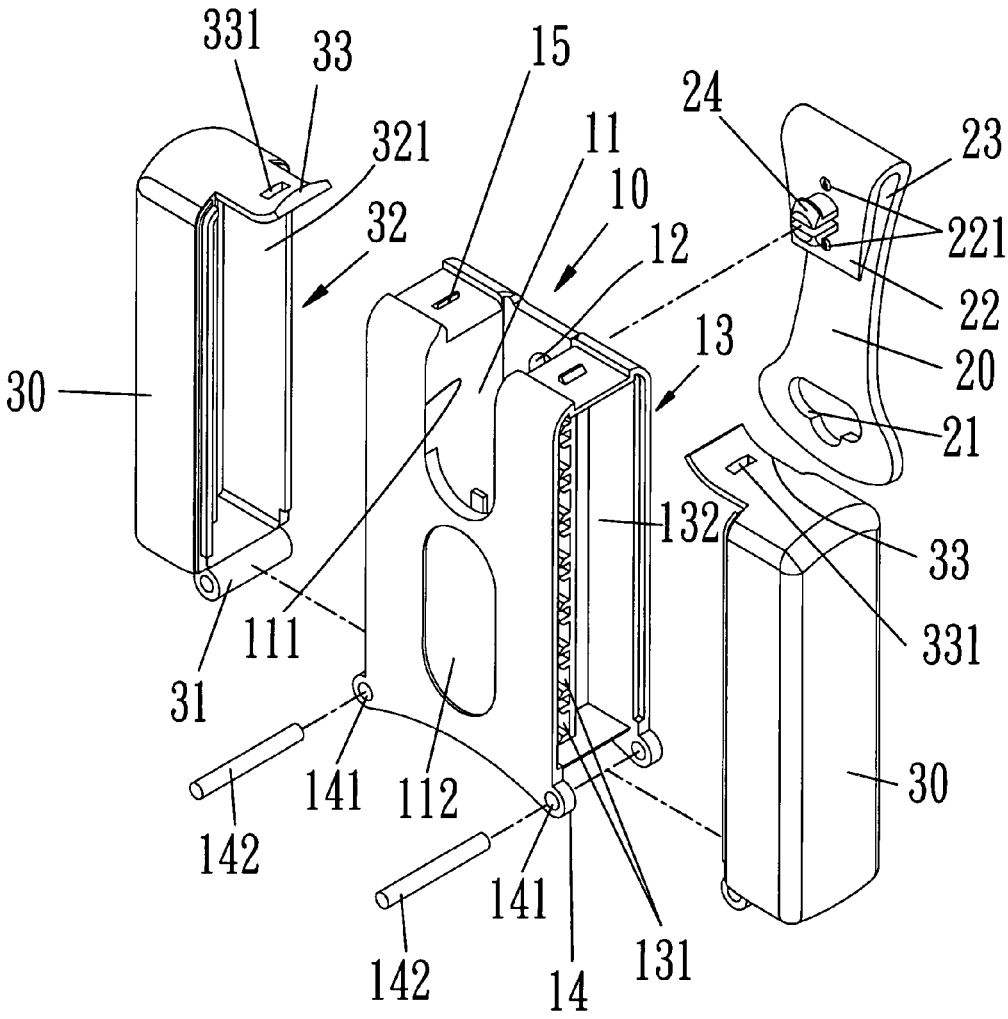
FIG. 1—an exploded view of the preferred embodiment
Figure 2:
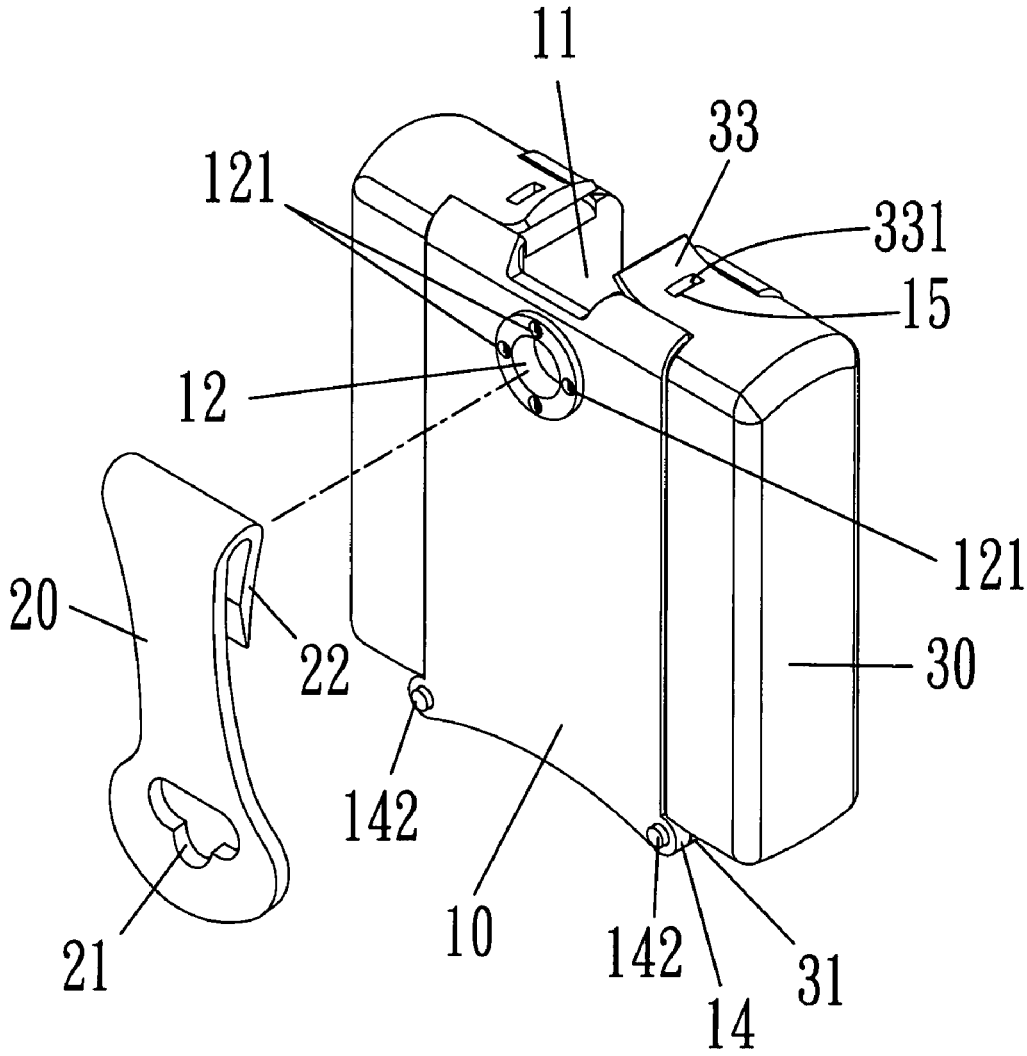
FIG. 2—a backside view of FIG. 1
Figure 3:
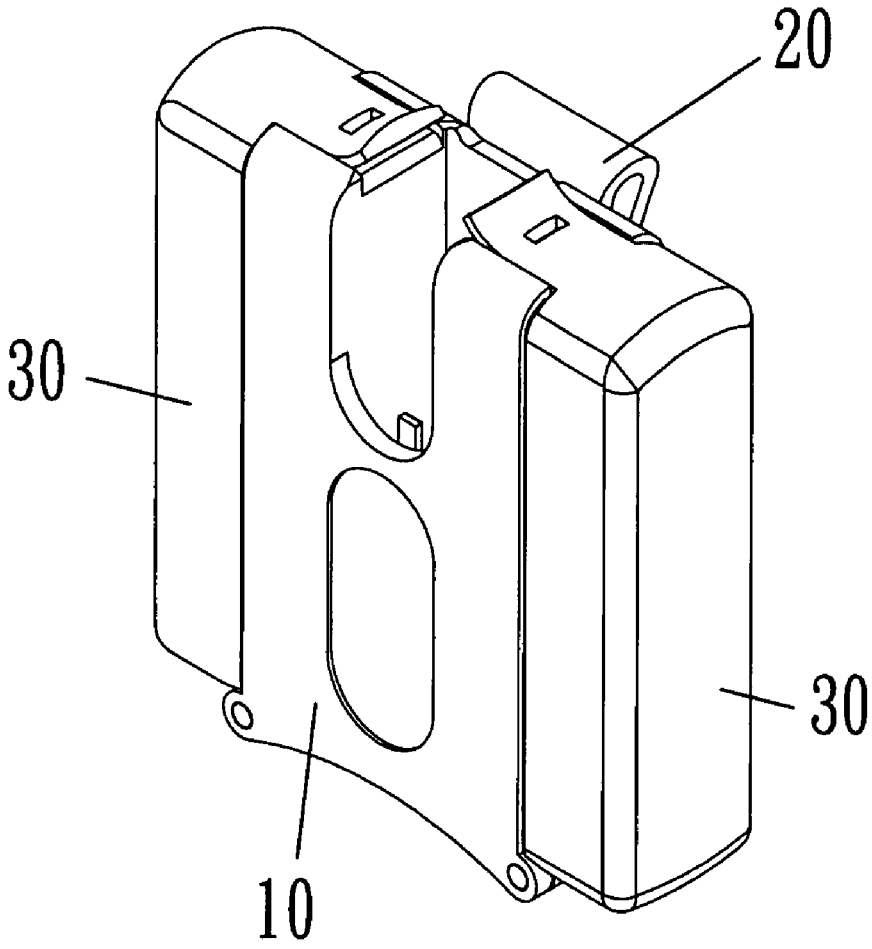
FIG. 3—a perspective of the preferred embodiment
Figure 4:
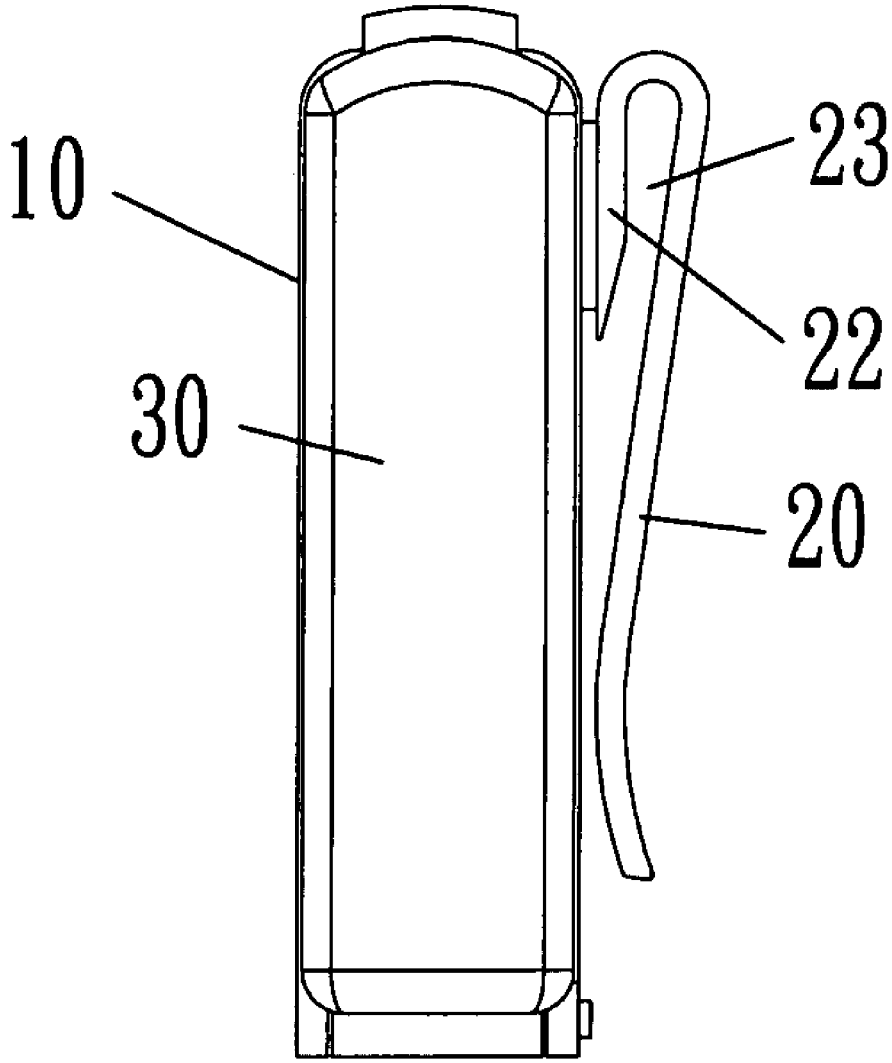
FIG. 4—a side view of the preferred embodiment

As shown in FIGS. 1 and 2, on the other hand, on the backside of main body 10 and around the hole 12 has multiple grooves 121 that lie in cross. And, at corresponding locations of curved clipping body 22 of the clip 20 has multiple round lumps 221 to cooperate with the multiple grooves 121 for well positioning the clip 20 on the main body 10. So that, the clip 20 can be firmly positioned with the main body 10 when it is rotated every 90-degree angel against the main body 10.

As shown in FIG. 1-8, on the front side of the main body 10 and around upper part of the longitudinal cavity 11 sets a open recess 111 for enlarging the open space of the longitudinal cavity 11 for easy pull-out of the driver bit 40. Moreover, on the front lower side of the main body 10 sets a shallow recess 112 for space to stick on name or trademark tag. (Not important part of this invention, thus shown in the figures.)

With all aforementioned, the invention deserves grant of a patent based on its capability of industrial application and absolute novelty. The example illustrated above is just an exemplary embodiment for the invention, and shall not be utilized to confine the scope of the patent. Any equivalent modifications within the scope of claims of the patent shall be covered in the protection for this patent.

What is claimed is:

1. A driver bits container comprising: a main body, a clip and two containing caps; wherein in the center of the said main body sets a longitudinal cavity, and the said main body further has two symmetrical containers on two sides of the said longitudinal cavity with each of them divided longitudinally into two parts: a row of containing slots and an elongated concave;

the two containing caps are mounted respectively on two sides of the main body with pivots at its bottom to rotate said containing caps and to cap on the said containers;

each of said containing caps further has a side container that is also divided into two parts: a row of side containing slots and a side elongated concave, which cooperate with said elongated concave and said row of containing slots, wherein an upper part of said longitudinal cavity further has an open recess enlarging an open space of said longitudinal cavity providing access to driver bits, and wherein said containing caps rotate up to 180-degrees to form a straight line in combination with said main body after opening said containing caps.

2. The driver bits container of claim 1, wherein the said main body has a hole on a backside of the said longitudinal cavity, and a circumference of said hole sets multiple grooves that cross said hole; the said clip has a curved clipping body with a projecting head on it, and there are also multiple round lumps around the said projecting head for cooperating with the said multiple grooves so that the said clip can be firmly positioned with the said main body when it is rotated every 90-degree angle against the said main body.

3. The driver bits container of claim 2, wherein the said clip has a hanging hole at its bottom.

4. The driver bits container of claim 1, wherein the said main body has symmetrical pivots at its bottom, and each of the said containing caps also, at its bottom, has a tubing component that can lie between its corresponding pivots when assembled; connecting rods are employed to penetrate the said tubing components and their corresponding pivots to connect the said main body and the containing caps.

5. The driver bits container of claim 1, wherein the said main body has positioning lumps on top of its two containers, and the said containing caps have outward curved plates with positioning concaves to buckle with the said positioning lumps.

6. The driver bits container of claim 1, wherein the said main body has a shallow recess on the front lower side as a space to stick on at least one of a name or a trademark tag.

* * * * *